US005171375A

United States Patent [19]

Wakabayashi et al.

[11] Patent Number: 5,171,375

[45] Date of Patent: Dec. 15, 1992

[54] TREATMENT OF TITANIUM ALLOY ARTICLE TO A MIRROR FINISH

[75] Inventors: Yutaka Wakabayashi; Kenzo Kato; Shigeru Miyama; Akihiko Abe, all of Tokyo, Japan

[73] Assignee: Seiko Instruments Inc., Japan

[21] Appl. No.: 579,467

[22] Filed: Sep. 6, 1990

[30] Foreign Application Priority Data

Sep. 8, 1989 [JP] Japan ..... 1-233922

[51] Int. Cl.[5] ..... C22F 1/00; C22C 14/00

[52] U.S. Cl. ..... 148/671; 148/421; 148/557; 420/417

[58] Field of Search ..... 148/11.5 F, 12.7 B, 148/133, 421; 420/417

[56] References Cited

U.S. PATENT DOCUMENTS

| | | | |
|---|---|---|---|
| 4,053,330 | 10/1977 | Henricks et al. | 148/12.7 B |
| 4,309,226 | 1/1982 | Chen | 148/12.7 B |
| 4,482,398 | 11/1984 | Eylon et al. | 148/12.7 B |
| 4,543,132 | 9/1985 | Berczik et al. | 148/12.7 B |
| 4,799,975 | 1/1989 | Ouchi et al. | 148/12.7 B |
| 4,842,653 | 6/1989 | Wirth et al. | 148/115 F |
| 4,854,977 | 8/1989 | Alheritiere et al. | 420/417 |
| 4,871,400 | 10/1980 | Shindo et al. | 148/11.5 F |
| 4,975,125 | 12/1990 | Chakrabarti et al. | 148/133 |

FOREIGN PATENT DOCUMENTS

| | | |
|---|---|---|
| 0181713 | 5/1986 | European Pat. Off. . |
| 0254891 | 2/1988 | European Pat. Off. . |
| 0263503 | 4/1988 | European Pat. Off. . |

OTHER PUBLICATIONS

Patent Abstracts of Japan, vol. 12, No. 84 (C-482) [2931] Mar. 17, 1988, Sumitomo Metal Ind. Ltd.

"Titanium: A Technical Guide", M. J. Donachie, Jr., pp. 27, 62-68 and 98-99, American Society for Metals, 1988.

*Primary Examiner*—Upendra Roy

*Attorney, Agent, or Firm*—Bruce L. Adams; Van C. Wilks

[57] ABSTRACT

The titanium alloy treatment process of the present invention comprises molding an $\alpha+\beta$ titanium alloy and a $\beta$ alloy, subjecting the resultant article to a $\beta$ solution treatment above the $\beta$ transformation point, quenching the treated article to room temperature to form a martensitic single phase or a $\beta$ single phase, subjecting the article to an aging treatment below the $\beta$ transformation point to finely precipitation an $\alpha$ precipitate on the martensite phase or the $\beta$ phase, and then subjecting the article to a mirror fining treatment to attain a mirror state.

3 Claims, 7 Drawing Sheets

TREATMENT OF TITANIUM ALLOY ARTICLE TO A MIRROR FINISH

BACKGROUND OF THE INVENTION:

The present invention relates to a titanium alloy treatment process.

The process of the present invention comprises molding an $\alpha+\beta$ titanium alloy and a $\beta$ alloy, subjecting the molded article to a $\beta$ solution treatment above the $\beta$ transformation point, quenching the treated article to room temperature to form a martensitic single phase or a $\beta$ single phase, subjecting the resultant article to an aging treatment below the $\beta$ transformation point to finely precipitate an $\alpha$ precipitate on the martensite phase or the $\beta$ phase, and then subjecting the article to a mirror finishing treatment to produce a mirror finish.

In general, an $\alpha+\beta$ titanium alloy article is a two-phase alloy comprising a hard phase and a soft phase and has a difference in the hardness and the workability between the $\alpha$ phase and the $\beta$ phase. Therefore, even when a mirror finishing process is conducted, a mirror finish can not be furnished. Further, in $\beta$ titanium alloy article as well, an $\alpha$ phase is present although the amount thereof is small, which makes it impossible to prepare a mirror finish state due to a difference in the hardness and the workability between the $\alpha$ phase and the $\beta$ phase even when a mirror finishing process is conducted.

The conventional heat treatment of a titanium alloy article has been conducted for the purpose of enhancing the strength or toughness of the same as disclosed in Japanese Patent Publication No. 48025/1983 and Japanese Patent Laid-Open No. 281860/1986 wherein the article is solution treated below the $\beta$ transformation point, and quenched and aged below the $\beta$ transformation point. In such a treatment, a proeutectoid $\alpha$ phase remains and there exists a difference in the hardness and the workability between the proeutectoid a phase and the phase precipitated from the $\beta$ phase by the aging treatment. Thus, a mirror state can not be obtained even when a mirror finish finishing process is conducted.

Therefore, a titanium alloy article has been used in a satin finish state or after a surface treatment such as overcoating.

A titanium alloy has many advantages such as high specific strength, high temperature strength and good corrosion resistance and therefore has been extensively used for construction or mechanical parts. In these products, a heat treatment is conducted for the purpose of imparting various attributes such as strength, thoughness, corrosion resistance and vibration resistance. In the past, there had been no desire to create a mirror finish state. In recent years, however, these products have been used for ornaments by virtue of features of the titanium alloy such as small specific gravity, good corrosion resistance, high hardness and high-grade finish. In this case, a surface treatment has been used such as overcoating or in a satin finish pattern but this treatment does not produce a mirror finish.

The reason for this is as follows. In the titanium alloy, both a hard phase and a soft phase exist (cf. FIG. 1 (A)), so that, in the mirror finishing treatment, the soft phase is selectively polished (cf. FIG. 1 (B)), or otherwise the soft phase becomes broken and fallen (cf. FIG. 1 (C)). This causes an uneven portion to be formed on a finished surface, so that a satin finish pattern is formed and no mirror finish state can be achieved.

SUMMARY OF THE INVENTION

An object of the present invention is to provide a treatment process which comprises converting a structure of an $\alpha+\beta$ titanium alloy or a $\beta$ titanium alloy from a martensitic single phase or a $\beta$ single phase to a texture wherein $\alpha$ and $\omega$ phases are homogeneously and finely precipitated. Another object of the present invention is to provide a titanium alloy treatment process which can provide ornaments without detriment to high hardness and marring resistance characteristic of a titanium alloy through mirror finishing as a post-treatment process.

BRIEF DESCRIPTION OF THE DRAWINGS

FIGS. 1 (B) and (C) are a conventional titanium alloy article after mirror finishing;

FIG. 2 (B) is a photomicrograph (×400) showing an alloy structure of Ti-9.5V-2.5Mo-3Al after a solution treatment (at 750° C. for 0.5 h) followed by oil cooling;

FIG. 2 (C) is a photomicrograph (×400) showing an alloy structure of Ti-9.5V-2.5Mo-3Al after a solution treatment (at 750° C. for 0.5 h) followed by oil quenching and an aging treatment (at 500° C. for 5 h);

FIG. 2 (D) is a photomicrograph (×400) showing an alloy structure of Ti-9.5V-2.5Mo-3Al after a solution treatment (at 850° C. for 0.5 h) followed by oil quenching;

FIG. 2 (E) is a photomicrograph (×400) showing an alloy structure of Ti-9.5V-2.5Mo-3Al after a solution treatment (at 850° C. for 0.5 h) followed by oil quenching and an aging treatment (at 400° C. for 16 h);

FIG. 2 (F) is a photomicrograph (×400) showing an alloy structure of Ti-9.5V-2.5Mo-3Al after a solution treatment (at 850° C. for 0.5 h) and an aging treatment (at 450° C. for 16 hr);

FIG. 2 (G) is a photomicrograph (×400) showing an alloy structure of Ti-9.5V-2.5Mo-3Al after a solution treatment (at 850° C. for 0.5 h) and an aging treatment (at 500° C. for 16 h);

FIG. 5 (B) is a photomicrograph (×400) showing an alloy structure of Ti-6Al-4V after a solution treatment (at 900° C. for 0.5 h) followed by oil quenching;

FIG. 5 (C) is a photomicrograph (×400) showing an alloy structure of Ti-6Al-4V after a solution treatment (at 900° C. for 0.5 h) followed by oil quenching and an aging treatment (at 600° C. for 5 h);

FIG. 5 (D) is a photomicrograph (×400) showing an alloy structure of Ti-6Al-4V after a solution treatment (at 1050° C. for 0.5 h) followed by oil quenching;

FIG. 5 (E) is a photomicrograph (×400) showing an alloy structure of Ti-6Al-4V after a solution treatment (at 1050° C. for 0.5 h) followed by oil quenching and an aging treatment (at 400° C. for 16 h);

FIG. 5 (F) is a photomicrograph (×400) showing an alloy structure of Ti-6Al-4V after a solution treatment (at 1050° C. for 0.5 h) followed by oil quenching and an aging treatment (at 500° C. for 16 h);

FIG. 5 (G) is a photomicrograph (×400) showing an alloy structure of Ti-6Al-4V after a solution treatment (at 1050° C. for 0.5 h) followed by oil quenching and an aging treatment (at 600° C. for 16 h);

FIG. 5 (H) is a photomicrograph (×400) showing an alloy structure of Ti-6Al-4V after a solution treatment (at 1050° C. for 0.5 h) followed by oil quenching and an aging treatment (at 600° C. for 16 h);

FIG. 8 (B) is a photomicrograph (×400) showing an alloy structure of Ti-15V-3Al-3Sn-3Cr after a solution treatment (at 750° C. for 10 min) followed by oil quenching;

FIG. 8 (C) is a photomicrograph (×400) showing an alloy structure of Ti-15V-3Al-3Sn-3Cr after a solution treatment (at 750° C. for 10 min) followed by oil quenching and an aging treatment (at 450° C. for 40 h);

FIG. 8 (D) is a photomicrograph (×400) showing an alloy structure of Ti-15V-3Al-3Sn-3Cr after a solution treatment (at 700° C. for 10 min) followed by oil quenching;

FIG. 8 (E) is a photomicrograph (×400) showing an alloy structure of Ti-15V-3Al-3Sn-3Cr after a solution treatment (at 700° C. for 10 min) followed by oil quenching and an aging treatment (at 450° C. for 40 h)

DETAILED DESCRIPTION OF THE INVENTION

The process of the present invention comprises subjecting an $\alpha+\beta$ titanium alloy and a $\beta$ titanium alloy to a $\beta$ solution treatment above the $\beta$ transformation point, quenching the treated alloy to room temperature, subjecting the quenched alloy to an aging treatment below the $\beta$ transformation point to precipitate a fine precipitate from the martensite phase and the $\beta$ phase on the whole surface.

The structure of an $\alpha+\beta$ titanium alloy is converted into a martensitic single phase when the alloy is heated and held above the $\beta$ transformation point ($\beta$ solution treatment) and then quenched. On the other hand, the structure of a $\beta$ titanium alloy is converted into a $\beta$ single phase when the alloy is heated and held above the $\beta$ transformation point and then quenched. Further, when the alloy is aged below the $\beta$ transformation point, a fine precipitate of an $\alpha$ phase or an $\omega$ phase is formed in the martensitic phase matrix or $\beta$ phase matrix. When the alloy is polished for mirror finishing in such a structure that an $\alpha$ phase or an $\omega$ phase is precipitated in a martensitic phase or an $\alpha$ phase or an $\omega$ phase is precipitated in a $\beta$ phase, the surface of the titanium alloy is uniformly polished and a mirror state can be furnished.

EXAMPLES

The present invention will now be described in more detail with reference to the attached drawings.

EXAMPLE 1

In the present Example, use was made of an $\alpha+\beta$ (near $\beta$) titanium alloy.

TABLE 1

| Ingredient | Ti | Al | Mo | V |
|---|---|---|---|---|
| wt % | balance | 3 | 2.5 | 9.5 |

Figure 1A:
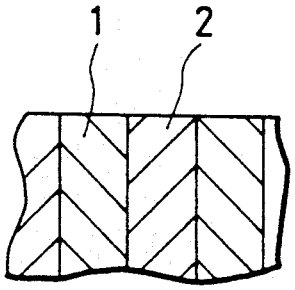
FIG. 1 (A) is a cross-sectional view of a conventional titanium alloy article before mirror finishing.
Figure 1B:
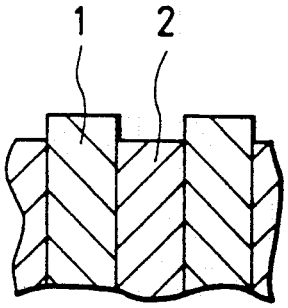
Figure 1C:
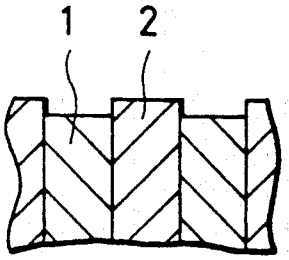
Figure 2:
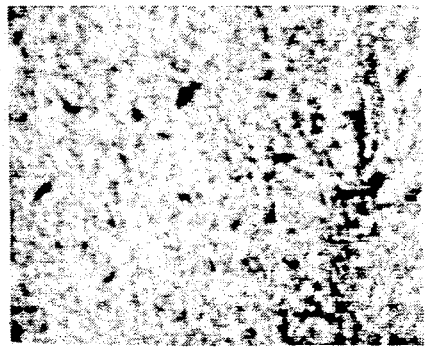
FIG. 2 (A) is a photomicrograph (×400) showing an alloy structure of Ti-9.5V-2.5Mo-3Al before a heat treatment.
Figure 2E:
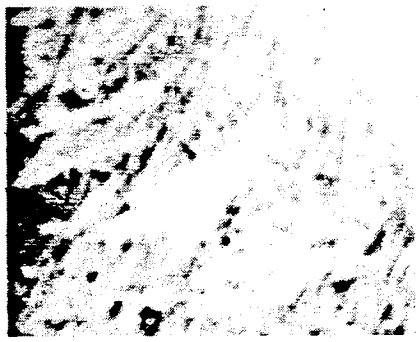
Figure 2B:
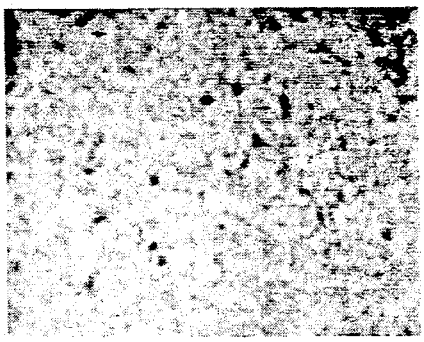
Figure 2F:
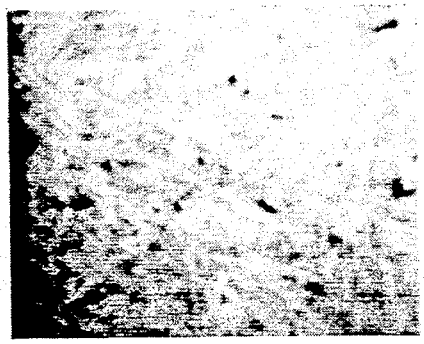
Figure 2C:
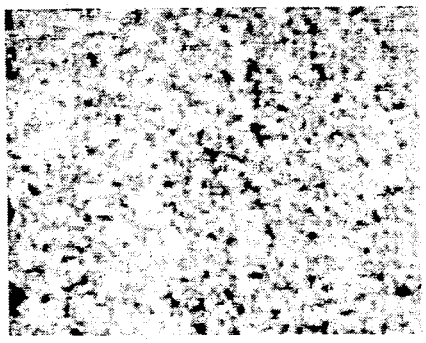
Figure 2G:
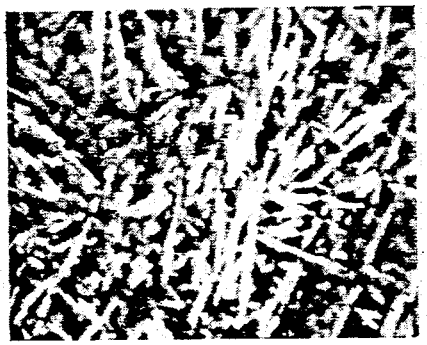
Figure 2D:
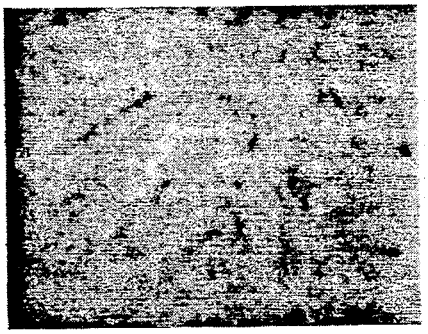

Structure of a titanium alloy subjected to various heat treatments are given in FIG. 2.

FIG. 2 (A) shows a structure of a titanium alloy before a heat treatment, wherein two phases of $\alpha$ and $\beta$ are present in the structure.

FIG. 2 (B) shows a structure of a titanium alloy after a solution treatment at 750° C. for 0.5 h followed by oil quenching, wherein two phases of $\alpha$ and $\beta$ are present in the structure.

TABLE 2

| Solution treatment | | | Aging treatment | | |
|---|---|---|---|---|---|
| temp. (°C.) | time | cooling | temp. (°C.) | time | cooling |
| 750 | 0.5 h | O.Q. | — | — | — |
| | | | 450 | 5 h | A.C. |
| | | | 500 | | |
| 820 | 5 h | O.Q. | 500 | 5 h | A.C. |
| 850 | 5 h | O.Q. | — | — | — |
| | | | 400 | 5 h | A.C. |
| | | | 500 | | |
| | | | 600 | | |
| 900 | 5 h | O.Q. | — | — | — |
| | | | 400 | 5 h | A.C. |
| | | | 500 | | |
| | | | 600 | | |
| 850 | 5 min | O.Q. | — | — | — |
| | 10 min | | 500 | 5 h | A.C. |
| 850 | 0.5 | O.Q. | — | — | — |
| | | | 400 | 2 | A.C. |
| | 5 h | | 450 | | |
| | | | 500 | 16 h | |

Note:
$\beta$ transformation point: 780° C.

FIG. 2 (C) shows a structure of a titanium alloy after a solution treatment at 750° C. for 0.5 h followed by oil quenching and an aging treatment at 500° C. for 5 h, wherein a fine $\alpha$ phase is precipitated from a $\beta$ phase and a proeutectoid $\alpha$ phase remains as it is.

FIG. 2 (D) shows a structure of a titanium alloy after a solution treatment at 850° C. for 0.5 h followed by oil quenching, wherein the structure is a martensitic one.

FIG. 2 (E) shows a structure of a titanium alloy after a solution treatment at 850° C. for 0.5 h followed by oil quenching, an aging treatment at 400° C. for 0.5 h and air cooling, wherein a fine $\omega$ phase is precipitated from a martensitic matrix.

FIG. 2 (F) shows a structure of a titanium alloy after a solution treatment at 850° C. for 0.5 h followed by oil quenching, an aging treatment at 400° C. for 16 h and air cooling, wherein a fine α phase or ω phase is precipitated from a martensitic matrix.

FIG. 2 (G) shows a structure of a titanium alloy after a solution treatment at 850° C. for 0.5 h followed by oil quenching, an aging treatment at 500° C. for 16 h and air cooling, wherein a fine acicular α phase is precipitated from a martensitic matrix.

Figure 3:
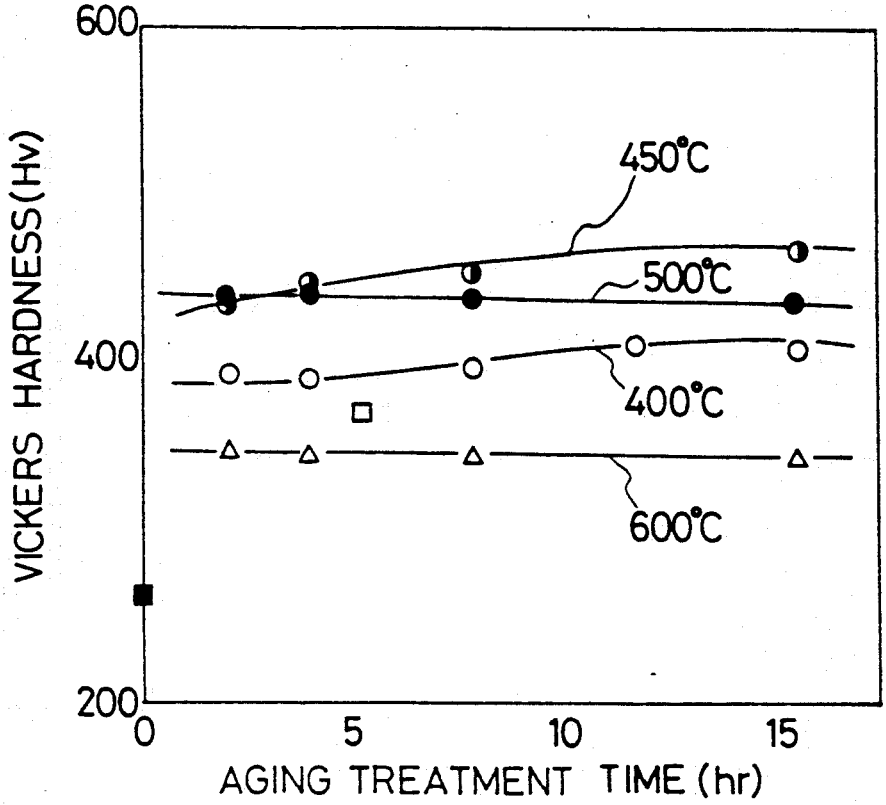
FIG. 3 is a graph showing a Vickers hardness of alloy of Ti-9.5V-2.5Mo-3Al after a solution treatment (at 850° C. for 0.5 h) followed by oil quenching and an aging treatment.
Figure 4:
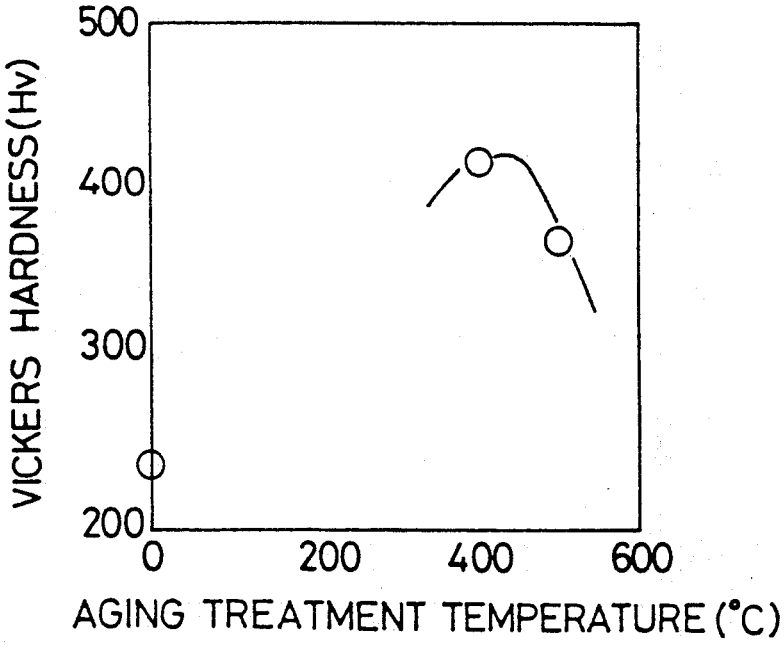
FIG. 4 is a graph showing a Vickers hardness of alloy of Ti-9.5V-2.5Mo-3Al after a solution treatment (at 750° C. for 0.5 h) followed by oil quenching and an aging treatment.
Figure 5A:
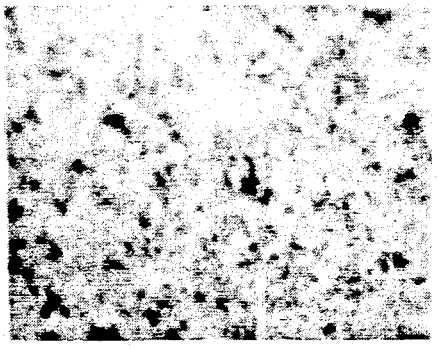
FIG. 5 (A) is a photomicrograph (×400) showing an alloy structure of Ti-6Al-6V before a heat treatment.
Figure 5B:
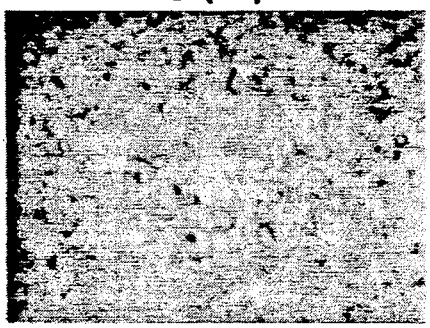
Figure 5C:
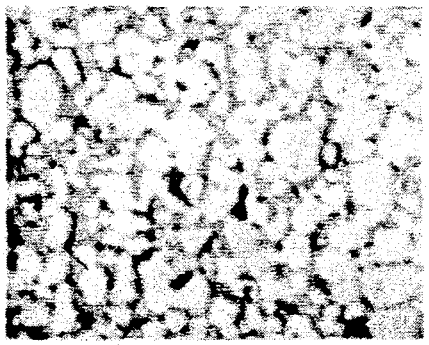
Figure 5D:
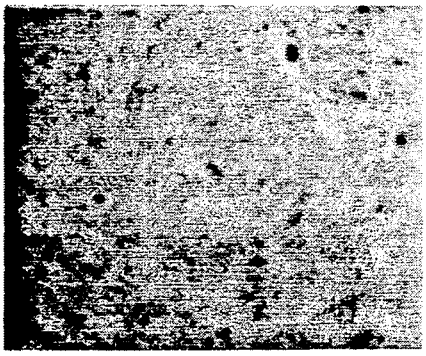
Figure 5E:
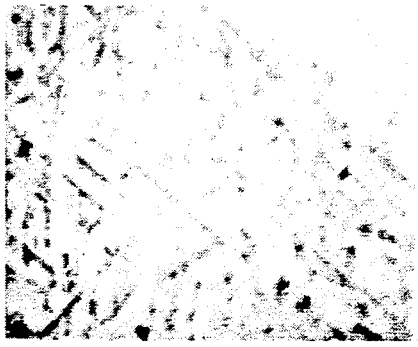
Figure 5F:
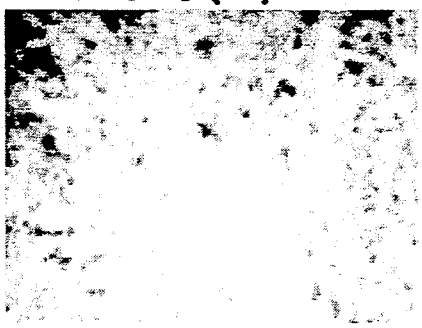
Figure 5G:
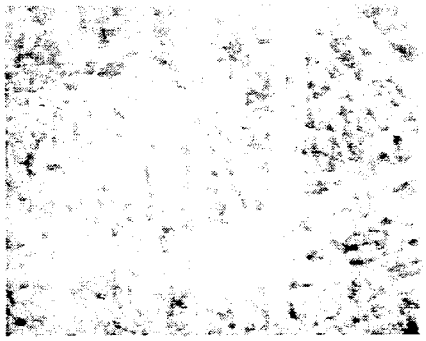
Figure 5H:
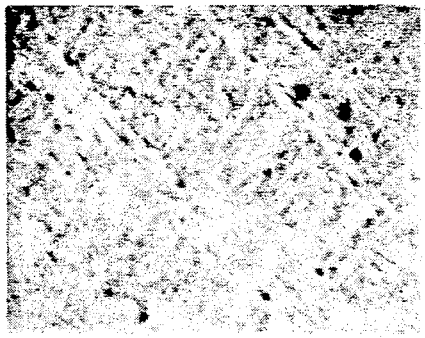

Thus, in the above-described titanium alloy, a martensitic single phase structure containing no α phase remaining therein was prepared through a solution treatment above the β transformation point (780° C.) followed by oil quenching. In this case, a period of 5 min or longer was necessary for the solution treatment. An aging treatment in this state below the β transformation point gave rise to a structure wherein a fine ω phase was precipitated from a martensitic matrix when the temperature was below 450° C. and a structure wherein a fine α phase was precipitated from a martensitic matrix when the temperature was above 450° C. On the other hand, when the alloy was solution treated below the β transformation point and then oil quenched, a two-phase structure of α and β was formed. A further aging treatment below the β transformation point brought about the formation of a structure wherein a fine α phase was precipitated from the β phase and a proeutectoid a phase remained in the structure. FIGS. 3 and 4 show the hardness of each of titanium alloys subjected to various heat treatments.

FIG. 3 is a graph showing the hardness of a titanium alloy after a solution treatment at 850° C. for 0.5 h followed by quenching and an aging treatment.

The titanium alloy subjected to only a solution treatment exhibited a Vickers hardness, Hv, of 260. In each aging treatment temperature, the Hv value was above 350 when the aging treatment time was 2h, i.e., the effect of the aging treatment was obtained.

This effect could be attained by virtue of the precipitation of a fine α phase or α phase from the martensitic matrix.

FIG. 4 is a graph showing the hardness of a titanium alloy after a solution treatment at 750° C. for 0.5 h followed by quenching and an aging treatment. The titanium alloy subjected to only a solution treatment exhibited a Vickers hardness, Hv, of 240. When this alloy was aged, the Hv value reached 420 when the aging treatment was conducted at 400° C. for 5 h and 370 when the aging treatment was conducted at 500° C. for 5 h. This suggests that the effect of hardening by precipitation of an α phase or ω phase from the α+β phase was attained.

The results of a mirror finishing treatment of a titanium alloy subjected to various heat treatment are shown in Table 3.

TABLE 3

| Solution treatment | | 850° C., 0.5 h (O.Q.) | | | | 750° C., 0.5 h (O.Q.) | |
|---|---|---|---|---|---|---|---|
| Aging treatment | | — | 400° C. 5 h | 450° C. 5 h | 500° C. 5 h | — | 500° C. 5 h |
| Surface roughness | max. Rmax (μm) | 0.541 | 0.265 | 0.407 | 0.323 | 1.036 | 0.323 |
| | min. Rmax (μm) | 0.222 | 0.109 | 0.105 | 0.166 | 0.104 | 0.152 |
| | average (μm) | 0.451 | 0.182 | 0.316 | 0.257 | 0.434 | 0.253 |
| Surface state | | corrugated | slightly satin | good | good | corrugated | satin |

Note:
*The mirror finishing was conducted by polishing with a sand paper, then with an abrasive and finally with a buff.

Table 3 shows a specific roughness and surface state after polishing. The surface roughness was represented in terms of the maximum value, the minimum value and the average value of the maximum surface roughness, Rmax, when measurements were conducted at seven points at intervals of 2 mm for each sample.

The titanium alloy subjected to a solution treatment at 750° C. for 0.5 h followed by an aging treatment at 500° C. for 5 h exhibited a Hv value of 370 and had low corrugation and surface roughness but resulted in an uneven polishing due to a difference in the hardness between the α phase and the β phase, so that a satin finish pattern was formed.

On the other hand, the titanium alloy subjected to a solution treatment at 850° C. for 0.5 h followed by oil quenching and an aging treatment at 450° C. for 5 h or at 500° C. for 5 h exhibited a high Vickers hardness and a low surface roughness. The titanium alloy comprised an α phase or an ω phase uniformly and finely precipitated in an martensitic matrix, was free from uneven polishing and provided a mirror finish state. The titanium alloy aged at 400° C. for 5 h brought about no complete precipitation of an α phase or an ω phase, so that slight uneven polishing was observed.

Thus, in the α+β titanium alloy, an excellent mirror state could be attained by solution-treating the alloy above the β transformation point, quenching the treated alloy, aging the alloy below the β transformation point to form a structure wherein a fine α phase or ω phase was precipitated from a martensitic matrix, and subjecting the alloy to a mirror finishing treatment.

EXAMPLE 2

In the present Example, various heat treatments specified in Table 5 were conducted by making use of a typical α+β titanium alloy listed in Table 4.

TABLE 4

| Ingredient | Ti | Al | V |
|---|---|---|---|
| wt % | balance | 6 | 4 |

Structures of a titanium alloy subjected to various heat treatments are given in Table 5.

FIG. 5 (A) shows a structure of a titanium alloy before heat treatment, wherein the structure comprises two phases of αand β.

FIG. 5 (B) shows a structure of a titanium alloy after a solution treatment at 900° C. for 0.5 h followed by oil quenching, wherein the structure comprises two phases of $\alpha$ and $\beta$.

TABLE 5

| Solution treatment | | | Aging treatment | | |
|---|---|---|---|---|---|
| temp. (°C.) | time (h) | cooling | temp. (°C.) | time (h) | cooling |
| 1050 | 0.5 | O.Q. | — | — | — |
| | | | 400 | 2–16 | A.C. |
| | | | 500 | | |
| | | | 600 | | |
| | | | 700 | | |
| 900 | 0.5 | O.Q. | — | — | — |
| | | | 600 | 5 | A.C. |

Note:
$\beta$ transformation point: 995° C.

FIG. 5 (D) shows a structure of a titanium alloy after a solution treatment at 1050° C. for 0.5 h followed by oil quenching, wherein the structure is a martensitic one.

FIG. 5 (E) shows a structure of a titanium alloy after a solution treatment at 1050° C. for 0.5 h followed by oil quenching, an aging treatment at 400° C. for 16 h and air cooling, wherein a fine $\omega$ phase is precipitated in a martensitic matrix.

FIG. 5 (F) to (H) each show a structure of a titanium alloy after a solution treatment at 1050° C. for 0.5 h followed by aging treatment at 500° C. for 16 h, at 600° C. for 16 h and at 700° C. for 16 h and air cooling, wherein a fine $\alpha$ phase is precipitated from a martensitic matrix.

Thus, the structure of the titanium alloy was converted into a martensitic single phase structure by solution-treating the alloy above the $\beta$ transformation point (995° C.) followed by cooling at a rate higher than that attained by oil quenching. A further aging treatment in this state below the $\beta$ transformation point gave rise to a structure wherein a fine $\omega$ phase was precipitated from a martensitic matrix (aging treatment temperature: 400° C.) or a structure wherein a fine $\alpha$ phase was precipitated from a martensitic matrix (aging treatment temperature: 400° C.). A solution treatment below the $\beta$ transformation point followed by oil quenching brought about a two-phase structure of $\alpha$ and $\beta$, and a further aging treatment below the $\beta$ transformation point gave rise to a structure wherein a fine $\alpha$ phase or $\omega$ phase was precipitated from a $\beta$ phase and a proeutectoid $\alpha$ phase remained in the structure.

Figure 6:
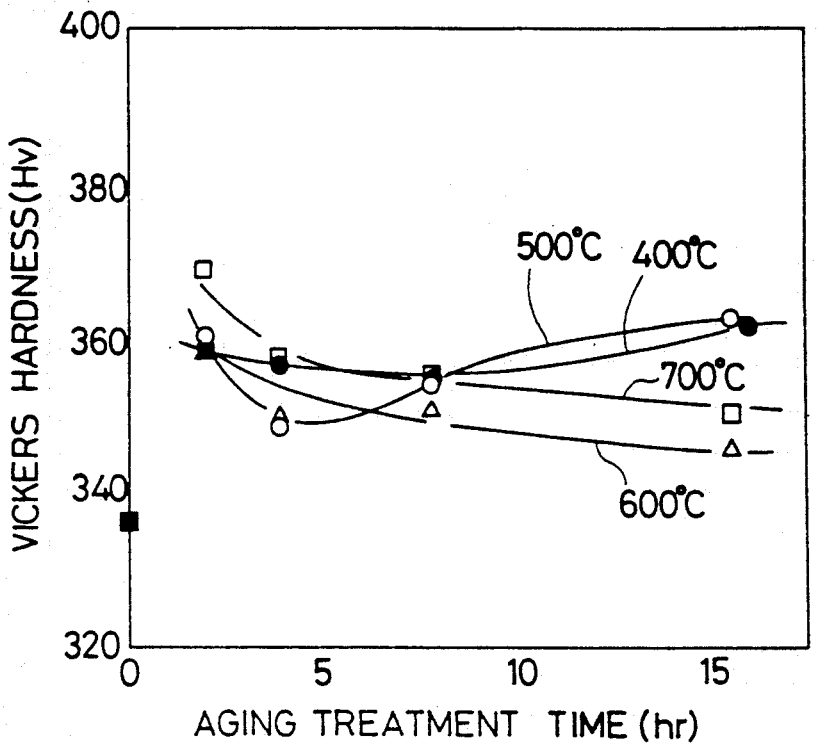
FIG. 6 is a graph showing a Vickers hardness of an alloy of Ti-6Al-4V after a solution treatment (at 1050° C. for 0.5 h) followed by oil quenching and an aging treatment.
Figure 7:
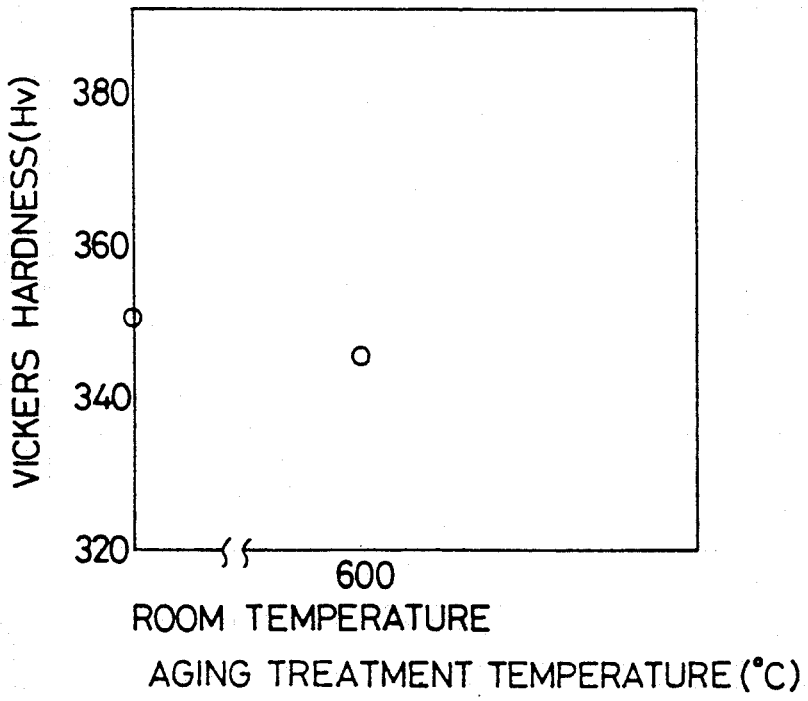
FIG. 7 is a graph showing a Vickers hardness of an alloy of Ti-6Al-4V after a solution treatment (at 900° C. for 0.5 h) followed by oil quenching and an aging treatment.
Figure 8A:
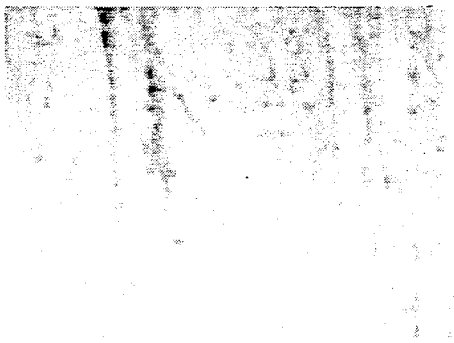
FIG. 8 (A) is a photomicrograph (×400) showing an alloy structure of Ti-15V-3Al-3Sn-3Cr before a heat treatment.
Figure 8D:
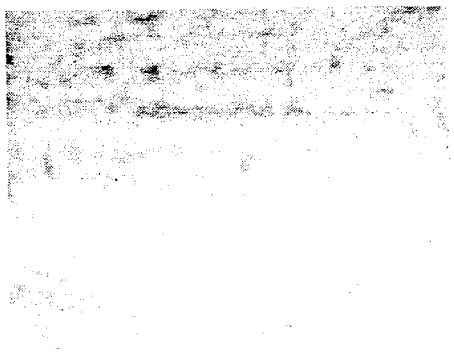
Figure 8B:
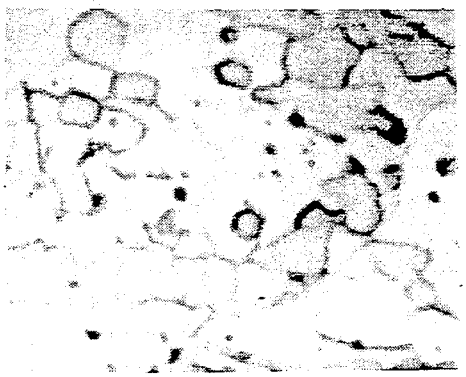
Figure 8E:
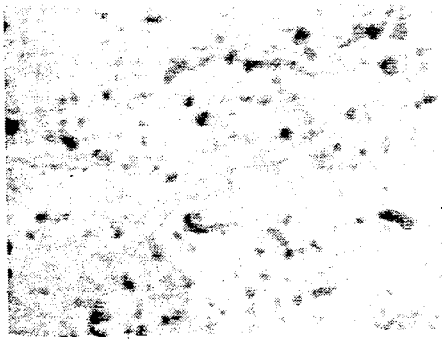
Figure 8C:
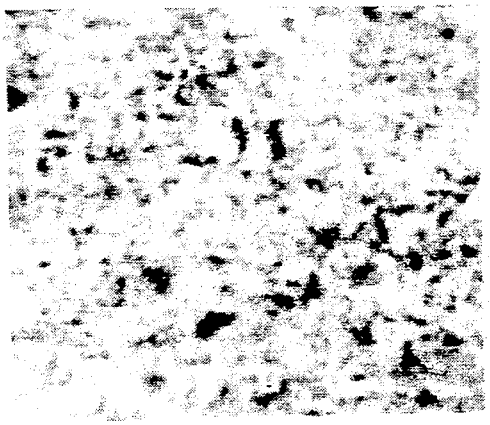

The hardnesses of titanium alloys subjected to various heat treatments are given in FIGS. 6 and 7.

The alloy subjected to a solution treatment at 1050° C. for 0.5 h followed by oil quenching exhibited a Vickers hardness, Hv, of 335. A further aging treatment below the $\beta$ transformation point improved the Hv value to 350 to 370. This effect derives from a structure wherein a fine $\alpha$ phase or $\omega$ phase is precipitated from a martensitic matrix.

On the other hand, a titanium alloy subjected to a solution treatment at 900° C. for 0.5 h followed by oil quenching exhibited a Hv value of 350. In this case, even when the alloy was further subjected to an aging treatment at 600° C. for 5 h, the Hv value was still 345. In other words, although a fine $\alpha$ phase was precipitated in a $\beta$ phase, no improvement in the hardness was attained because the amount of the $\beta$ phase was small.

The results of a mirror finishing treatment of titanium alloys subjected to various heat treatments are given in Table 6.

TABLE 6

| Solution treatment | | 1050° C., 0.5 h (O.Q.) | | | | | 900° C., 0.5 h (O.Q.) | |
|---|---|---|---|---|---|---|---|---|
| Aging treatment | | — | 400° C. 16 h | 500° C. 16 h | 600° C. 16 h | 700° C. 16 h | — | 600° C. 5 h |
| Surface roughness | max. Rmax (μm) | 0.804 | 0.531 | 0.329 | 0.199 | 0.163 | 0.649 | 0.415 |
| | min. Rmax (μm) | 0.161 | 0.083 | 0.110 | 0.095 | 0.091 | 0.331 | 0.237 |
| | average (μm) | 0.521 | 0.261 | 0.200 | 0.136 | 0.132 | 0.412 | 0.299 |
| Surface state | | satin | slightly satin | good | good | good | slightly satin | satin |

Note:
*The mirror finishing was conducted by polishing with a sand paper, then with an abrasive and finally with a buff.

As is apparent from Table 6, the titanium alloy subjected to a solution treatment at 900° C. for 0.5 h followed by oil quenching and the titanium alloy subjected to a further aging treatment at 600° C. for 5 h provided no mirror state even when a mirror finishing treatment was conducted. By contrast, the titanium alloys subjected to a solution treatment at 1050° C. for 0.5 h followed by oil quenching and an aging treatment at 500° C. for 16 h, at 600° C. for 16 and at 700° C. for 16 h provided an excellent mirror state through a mirror finishing treatment. However, when the aging treatment was conducted at 400° C. for 16 h, an $\alpha$ phase or $\omega$ phase was not completely precipitated, so that no mirror state could be furnished.

As is apparent from the foregoing description, in the $\alpha+\beta$ titanium alloy, an excellent mirror state can be provided by solution-treating the alloy above the $\beta$ transformation point, quenching the alloy to room temperature, aging the quenched alloy below the $\beta$ transformation point to form a structure wherein a fine $\alpha$ phase or $\omega$ phase is precipitated in a martensitic matrix, and subjecting the aged alloy to a mirror finishing treatment.

EXAMPLE 3

In the present Example, various heat treatments specified in Table $\beta$ were conducted by making use of a $\beta$ titanium alloy listed in Table 7.

TABLE 7

| Ingredient | Ti | V | Al | Sn | Cr |
|---|---|---|---|---|---|
| wt % | balance | 15 | 3 | 3 | 3 |

TABLE 8

| Solution treatment | | | Aging treatment | | |
|---|---|---|---|---|---|
| temp. (°C.) | time | cooling | temp. (°C.) | time | cooling |
| 750 | 10 min | O.Q. | — | — | — |
| | | | 400, 450 | 5 min | A.C. |

TABLE 8-continued

| Solution treatment | | | Aging treatment | | |
|---|---|---|---|---|---|
| temp. (°C.) | time | cooling | temp. (°C.) | time | cooling |
| | | | 550, 550 | 120 h | |
| | | | 600, 650 | | |
| | | | 700 | | |
| 700 | 10 min | O.Q. | — | — | — |
| | | | 450 | 40 h | A.C. |

Note:
$\beta$ transformation point: 730° C.

The structure of titanium alloys subjected to various heat treatments are shown in FIG. 8.

FIG. 8 (A) shows a structure of a titanium alloy before a heat treatment, wherein a $\beta$ grain boundary is extended.

FIG. 8 (B) shows a structure of a titanium alloy after a solution treatment at 750° C. for 10 min followed by oil quenching, wherein the structure is an isometric $\beta$ single phase structure.

FIG. 8 (C) shows a structure of a titanium alloy after a solution treatment at 750° C. for 10 min followed by oil quenching and an aging treatment at 450° C. for 40 h, wherein a fine $\alpha$ phase is precipitated from the whole $\beta$ phase.

FIG. 8 (D) shows a structure of a titanium alloy after a solution treatment at 700° C. for 10 min followed by oil quenching, wherein a phase is contaminated with an $\alpha$ phase.

FIG. 8 (E) shows a structure of a titanium alloy after a solution treatment at 700° C. for 10 min followed by oil quenching and an aging treatment at 450° C. for 40 h, wherein a proeutectoid $\alpha$ phase remains in the structure although a fine $\alpha$ phase is precipitated from a $\beta$ phase.

Thus, in the above-described titanium alloy, a structure wherein a fine $\alpha$ or $\omega$ phase is precipitated from a $\beta$ phase is prepared by solution-treating the alloy above the $\beta$ transformation point (730° C.) and cooling the treated alloy to room temperature at a rate higher than that attained by oil quenching to form a $\beta$ single phase structure and then aging the alloy below the $\beta$ transformation point.

Figure 9:
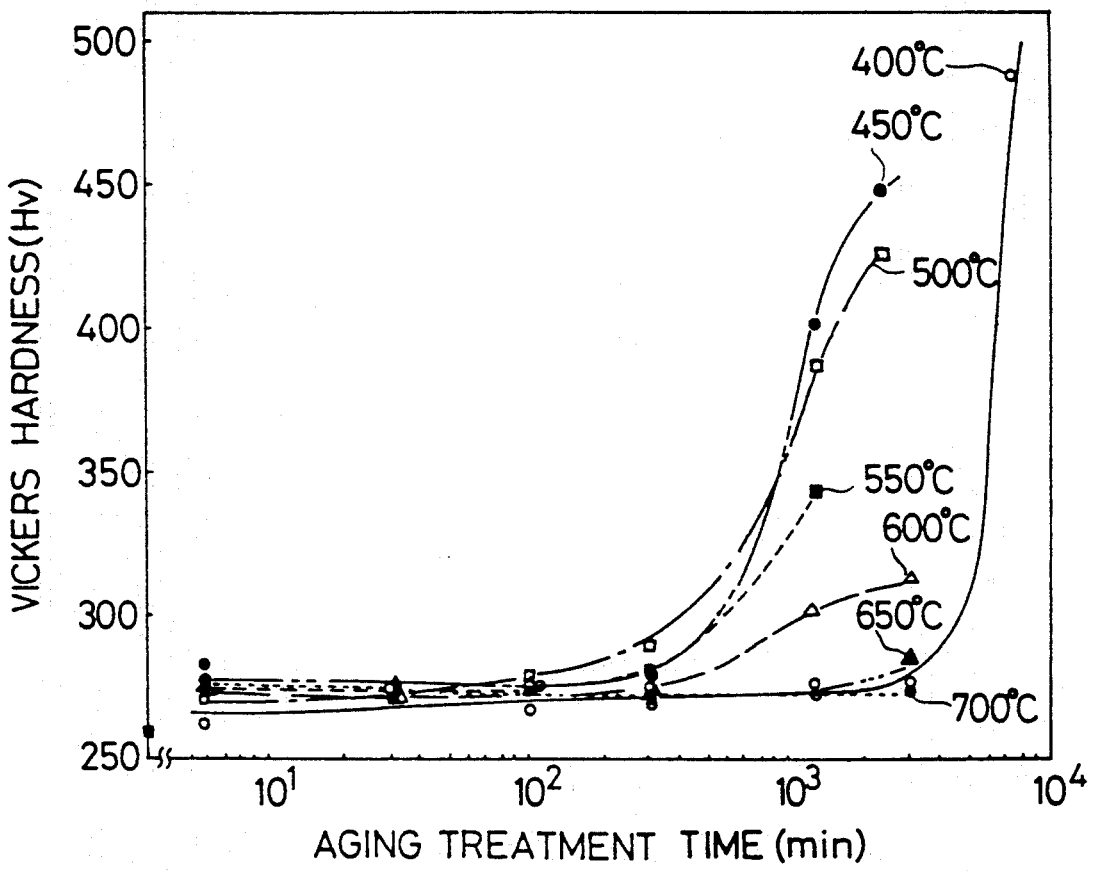
FIG. 9 is a graph showing a Vickers hardness of an alloy of Ti-15V-3Al-3Sn-3Cr after a solution treatment (at 700° C. for 10 min) followed by oil quenching and an aging treatment.

The hardnesses of titanium alloys subjected to various heat treatments are given in FIG. 9.

As is apparent from FIG. 9, the alloy subjected to a solution treatment at 750° C. for 10 min followed by oil quenching exhibited a Vickers hardness, Hv, of 260, and the aging treatment below 600° C. provided a Hv value of about 300. The effect of the aging treatment could be attained when the aging time was above 40 h. This is because a fine $\alpha$ phase or $\omega$ phase is precipitated from the $\beta$ phase. The results of a mirror finishing treatment of titanium alloys subjected to various heat treatments are given in Table 9.

TABLE 9

| Solution treatment | | 750° C., 0.5 h (O.Q.) | | 700° C., 0.5 h (O.Q.) | |
|---|---|---|---|---|---|
| Aging treatment | | — | 500° C. 40 h | — | 450° C. 40 h |
| Surface roughness | max. Rmax (μm) | 1.897 | 0.212 | 0.470 | 0.473 |
| | min. Rmax (μm) | 0.525 | 0.075- | 0.279 | 0.256 |
| | average (μm) | 1.029 | 0.151 | 0.380 | 0.392 |
| Surface state | | satin | good | satin | satin |

Note:
*The mirror finishing was conducted by polishing with a sand paper, thin with an abrasive and finally with a buff.

As is apparent from Table 9, the titanium the titanium alloy subjected to a solution treatment at 750° C. for 10 min followed by oil quenching and an aging treatment at 450° C. for 40 h provided an excellent mirror state through a mirror finishing treatment.

As is apparent from the foregoing description, in a $\beta$ titanium alloy, an excellent mirror state can be attained by solution-treating the alloy above the $\beta$ transformation point, quenching the treated alloy to room temperature, aging the alloy below the $\beta$ transformation point to form a structure wherein a fine $\alpha$ phase of $\omega$ phase is precipitated from a $\beta$ phase, and subjecting the aged alloy to a mirror finishing treatment.

As is apparent from the foregoing description, according to the present invention, a structure wherein a fine $\alpha$ phase or $\omega$ phase is uniformly precipitated from a martensitic single phase or a $\beta$ single phase can be formed by heat-treating an $\alpha+\beta$ titanium alloy or $\beta$ titanium alloy, and an excellent mirror state can be attained by a mirror finishing treatment of such a structure. This makes it possible to provide ornaments having a high-grade finish due to an imparted mirror surface effect without detriment to the high hardness and marring resistance characteristics or a titanium alloy.

What is claimed is:

1. A process for treating an $\alpha+\beta$ titanium alloy or a $\beta$ titanium alloy, comprising the steps of: converting the main structure of said $\alpha+\beta$ titanium alloy or $\beta$ titanium alloy into a martensitic phase or a $\beta$ phase; and forming from either of said martensitic phase and said $\beta$ phase and a precipitate comprising at least one of an $\alpha$ phase and an $\omega$ phase and performing a mirror finishing process on the $\alpha+\beta$ titanium alloy or the $\beta$ titanium alloy.

2. A process for manufacturing a titanium alloy article comprising an $\alpha+\beta$ titanium alloy or a $\beta$ titanium alloy, comprising the steps of:

forming said $\alpha+\beta$ titanium alloy or said $\beta$ titanium alloy into an article having a desired shape;

subjecting said article to a $\beta$ solution treatment above the $\beta$ transformation point;

quenching said article to room temperature;

aging said article below the $\beta$ transformation point;

gradually cooling said article to room temperature; and polishing said article.

3. A process for manufacturing a titanium alloy article having a mirror finish and comprising either of an $\alpha+\beta$ titanium alloy and a $\beta$ titanium alloy, comprising the steps of: forming either of an $\alpha+\beta$ titanium alloy and a $\beta$ titanium alloy into an article having a desired shape; treating the article in a $\beta$ solution treatment above the $\beta$ transformation point; quenching the article to room temperature; aging the article below the $\beta$ transformation point; gradually cooling the article to room temperature; and polishing the article to a mirror finish.

* * * * *